United States Patent [19]

Salazar

[11] Patent Number: 4,765,025

[45] Date of Patent: Aug. 23, 1988

[54] VEHICLE DOOR MOUNTING ASSEMBLY FOR EFFECTING VERTICAL REMOVABILITY

[75] Inventor: Sumorfin Salazar, Toledo, Ohio

[73] Assignee: Ford Motor Company, Dearborn, Mich.

[21] Appl. No.: 947,075

[22] Filed: Dec. 29, 1986

[51] Int. Cl.[4] ..... E05D 7/10; E05D 7/12

[52] U.S. Cl. ..... 16/261; 16/266; 16/380

[58] Field of Search ..... 16/222, 261, 265, 266, 16/380, 381, 390, 391, 392

[56] References Cited

U.S. PATENT DOCUMENTS

| | | | |
|---|---|---|---|
| 132,053 | 10/1872 | Child | 16/266 |
| 230,491 | 7/1880 | Peer | 16/266 |
| 417,234 | 12/1889 | Davis | 16/266 |
| 2,603,824 | 7/1952 | Evans | 16/261 |
| 3,510,986 | 5/1970 | Berkowitz . | |
| 3,643,755 | 2/1972 | Gionet et al. | 16/222 X |
| 3,975,793 | 8/1976 | Just | 16/265 |
| 4,532,675 | 8/1985 | Salazar | 16/374 X |
| 4,542,558 | 9/1985 | Brockhaus . | |
| 4,573,239 | 3/1986 | Valenti et al. | 16/380 X |

*Primary Examiner*—Fred Silverberg

*Attorney, Agent, or Firm*—Daniel M. Stock; Clifford L. Sadler

[57] ABSTRACT

A mounting arrangement for a vehicle door is provided in which one of two vertically spaced hinges is the type that permits separation of the part connected to the vehicle body from the type connected to the door through lifting one with respect to the other and the other is a conventional hinge fixed to the body through a single fastener.

8 Claims, 2 Drawing Sheets

FIG. 1.
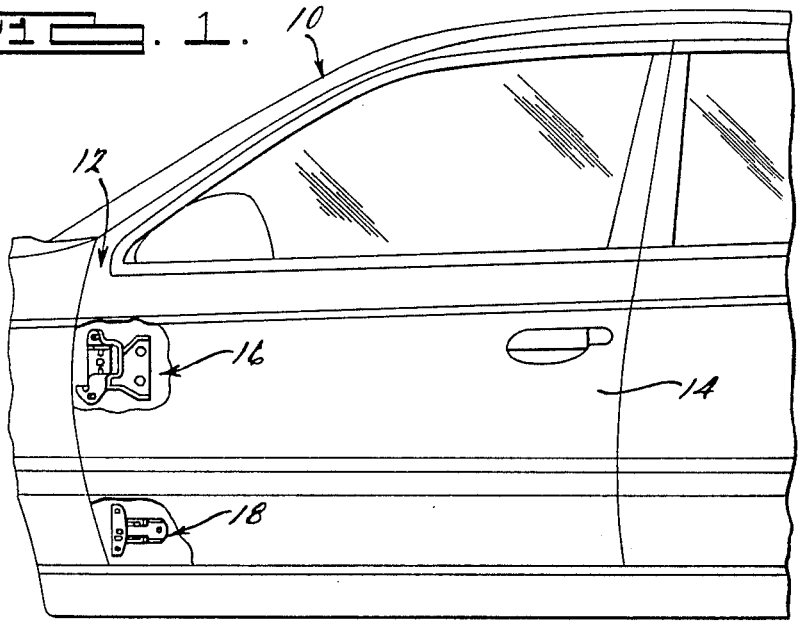
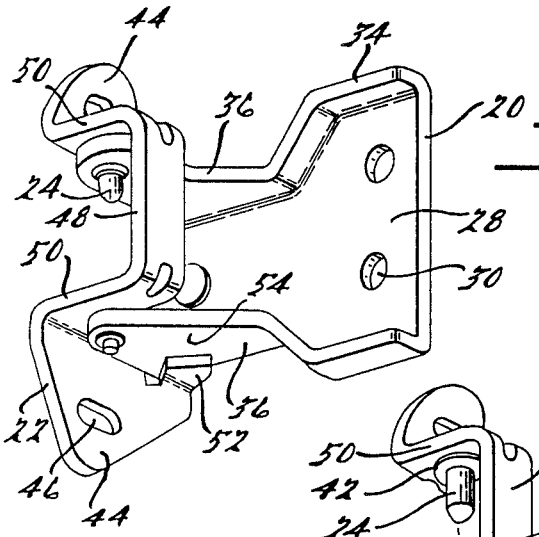
FIG. 2.
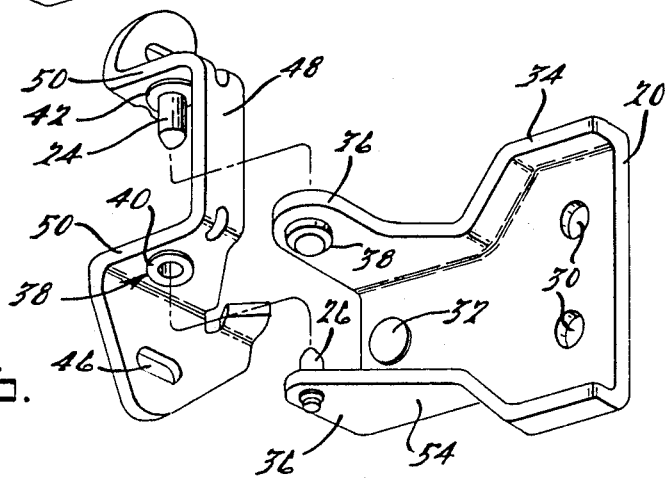
FIG. 3.

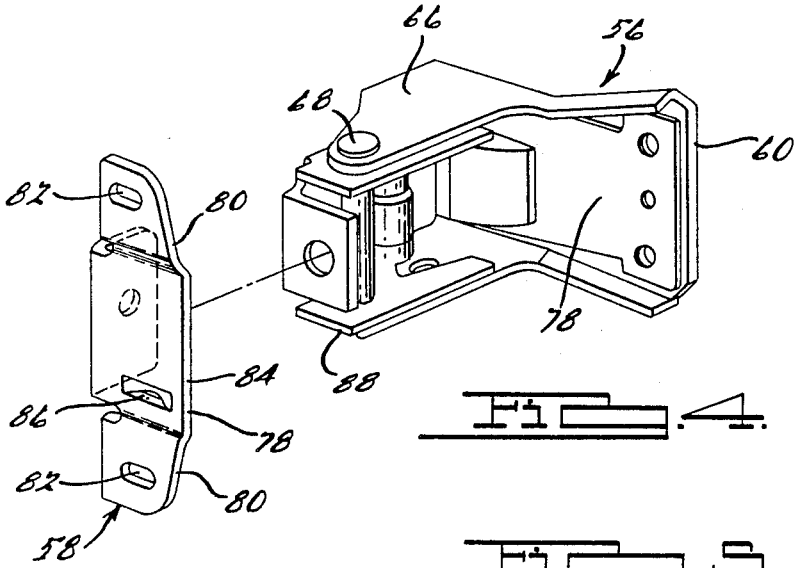
FIG. 4.
FIG. 5.
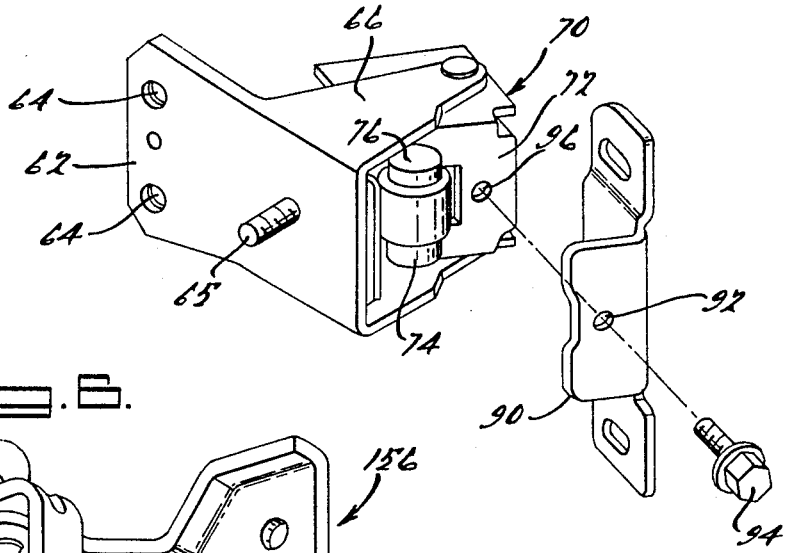
FIG. 6.
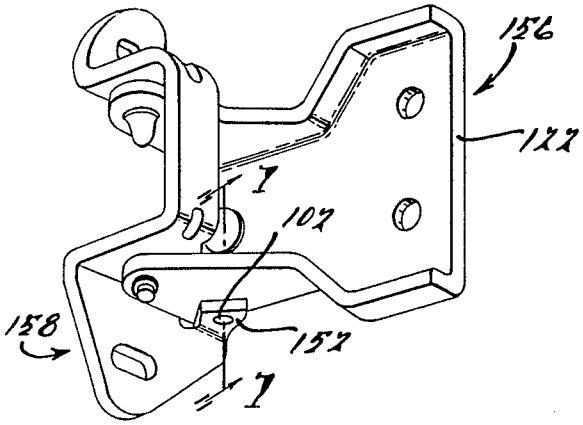
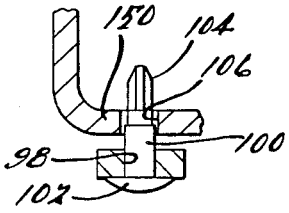
FIG. 7.

VEHICLE DOOR MOUNTING ASSEMBLY FOR EFFECTING VERTICAL REMOVABILITY

BACKGROUND OF THE INVENTION

The present invention relates generally to methods for mounting automotive vehicle doors and more specifically to the arrangement of door hinges for effecting this mounting through the use of certain types of hinges which may be characterized as lift-off door hinges; that is, those whose assembly and disassembly may be effected through the lifting on or off of one hinge part with respect to another.

DESCRIPTION OF THE PRIOR ART

The primary practice heretofore in the automotive industry in the assembling of doors to vehicles during the assembly of the vehicle has been to fixedly secure a substantially fully assembled hinged element together with all its moving parts to either the body of the vehicle or to the door and to fixture the door and the body aperture that receives it on the vehicle assembly line to accurately position the door with respect to the body aperture and then fasten the door with its complete hinges to the vehicle body. This fastening is accomplished through fixedly securing a mounting portion of the hinge assembly to body and door of the vehicle. This technique is considered less than desirable in modern automotive assembly lines in which it has been found that manufacturing efficienies can be achieved through the complete offline assembly and even painting of vehicle doors separate from the remainder of the vehicle body. The assembly technique described does not readily permit the manufacturing flexibility of disassembly of the door after fitting to permit the body to continue along an assembly line without doors and to permit further work to be performed on the door assembly itself. One of the practical drawbacks is that this assembly of such hinges necessarily requires removing a number of fastening elements to permit door removal.

Responsive to this deficiency, certain automotive manufacturers, including the assignee of the present invention have begun to design, develop and manufacture so called lift-off hinges which can permit ready removal of a door from a vehicle body. The principle of the lift-off hinge is well known, it being used in the architectural industry in ordinary doors and in the furniture and applicance industries for cabinet doors of different sorts. U.S. Pat. No. 3,510,986, Berkowitz, is exemplary of the appliance industry's use of such hinges. The automotive industry, however, has been unable to directly follow the lead of the other industries since the wide variation in operating conditions including variations in vibration environment, temperature, loading and required life is such that none of the known hinges has been found to be acceptable.

Prior to the present invention, the only automotive use of such hinges has been of the type illustrated in U.S. Pat. No. 4,542,558, Brockhaus. Such hinges are less than entirely acceptable for a number of reasons. First, they carry such a large share of the load of the vehicle door through the hinge pins that they are necessarily fabricated using structural mounting portions which are formed from wrought material, typically forgings. This is often an unacceptable, expensive technique to use in manufacturing on the large scale encountered in the automotive industry.

Secondly, they have required separate retaining mechanisms, such as clips, threaded fasteners and the like to prevent inadvertent lifting off of the door and undesired opening or closing positions of the door.

Thirdly, the proposed construction of such hinges has, partly because of the need for the choice of wrought materials in forming the structural members not provided for the integration of a check function with the door hinge as is known to be desirable in the construction of automotive vehicle systems.

Fourthly, when such hinges are used as a pair for pivotally supporting vehicle doors, they have been found to require extremely precise location during any refitting of the doors after disassembly.

SUMMARY OF THE INVENTION

Responsive to the deficiencies in the prior art, the present invention provides a system for mounting automotive vehicle doors which includes an improved lift-off door hinge together with a conventional door hinge having an integral check modified to cooperate with the lift-off door hinge to permit the desirable ready assembly and disassembly of the door with respect to the automotive vehicle body during movement of the vehicle body along a modern automotive assembly line.

BRIEF DESCRIPTION OF THE DRAWINGS

The listed improvements that the vehicle door mounting system of the present invention and its hinge elements over the prior art will be readily appreciated by those skilled in the arts of automotive door and hinge design by reading the following description with reference to the accompanying drawings in which:

FIG. 1 is a side elevational view of a door portion of an automotive vehicle with portions broken away to show the mounted position of the door hinges;

FIG. 2 is a perspective view of the lift-off door hinge of the present invention;

FIG. 3 is an exploded view of the hinge of FIG. 1 illustrating the assembly and disassembly path of the hinge parts;

FIG. 4 is an exploded view of the lower hinge of FIG. 1;

FIG. 5 is a rear perspective view of the hinge of FIG. 4;

FIG. 6 is a perspective view of a second embodiment of the lift-off hinge of FIG. 2; and FIG. 7 is a cross-sectional view taken along Line VII—VII of FIG. 6.

DESCRIPTION OF THE PREFERRED EMBODIMENTS

Turning now to the drawings and particularly to FIG. 1, vehicle 10 is illustrated in part as comprising generally a body 10 and a door 14. The door 14 is secured to portions of the body by an upper lift-off door hinge assembly, indicating generally at 16, and a lower door hinge assembly, indicated generally at 18.

Turning next to FIGS. 2 and 3, the upper lift-off door hinge assembly 16 is shown in more detail. It includes essentially a body mounting plate 20 and a door mounting plate 22. The plates 20, 22 are mounted for relative pivotal movement through upper and lower pivot pins 24, 26, respectively.

The body plate 20 is formed as a metal stamping and includes a mounting portion such as the flat portion 28 configured to abuttingly engage a portion of the vehicle body 12. Provisions are made in the mounting portion, such as the apertures 30, for receiving fasteners for fixedly securing the plate 20 to the vehicle body 12. Other fastening arrangements such as indicated by the bolt 32 are also employed as required in the vehicle assembly process. In stamping the body plate 20, there are also formed upstanding edge portions 34, including spaced trunion portions 36 extending substantially away from the surface of mounting with the vehicle body 12. In the upper of the trunion portions 36, a bearing member such as that indicated at 38 in both the body plate 20 and the door plate 22 is secured. The bearings 38 are formed of suitable rotative load bearing material, such as bronze, and are sized to permit rotating engagement with the upper and lower pivot pins 24, 26. They are fixedly secured in the respective mounting plates 20, 22 and include a bearing shoulder portion 40 presenting a radially extending bearing surface for slidingly abuttingly engaging a corresponding bearing surface 42 formed on the pivot pins 24, 26.

The door mounting plate 22 is likewise formed as a metallic stamping and includes spaced mounting feet 44 generally having a flat surface for abutting engagement with a portion of the door 14. The mounting feet are preferably pierced by slots 46 to provide a range for adjustment in positioning fasteners (not shown) received through the slots 46. The mounting feed 44 are joined by a generally U-shaped portion 48 having legs 50 extending perpendicularly from the mounting feet 44. The upper leg 50 receives the upper pivot pin 24 arranged in mirror image fashion with respect to the lower pivot pin 26 carried in the lower trunion 36 of the body plate 20. Similarly, the lower leg 50 fixedly carries the bearing 38 arranged in mirror image fashion with respect to the bearing 38 carried in the upper trunion portion 36 of the body mounting plate 20.

As can best be seen in FIG. 3, the body mounting plate 20 and the door mounting plate 22 are pivotally mounted with respect to each other by moving the lower leg 50 of bridge portion 48 between the upstanding trunion portions 36 to a position in which the pivot pins 24, 26 are aligned with and insertable into the bearings 38. This movement in insertion, though, is made impossible in the configuration shown when the relative pivotal position of the body mounting plate 20 and the door mounting plate 22 are that defining the closed position of the vehicle door 14 such as is shown in FIG. 2 by the provision of the upstruck abutment tab 52 extending from the lower of the mounting feet 44. This tab 52 is provided to abuttingly engage the lower surface 54 of the lower trunion portion 36 to prevent the lifting off and separation of the hinge parts when the door 40 is in the closed position.

Turning next to FIG. 4, the lower door hinge assembly 18 is illustrated as including a hinge and door check assembly 56 and a lower door mounting plate 58. The hinge and door check assembly 56 may be generally of the type included in Applicant's U.S. Patent 4,532,675 and includes a lower body mounting plate 60, formed as a stamping and including a flat mounting portion 62 pierced by apertures 64 providing for cooperation with suitable fasteners for securing to the vehicle body 12. The lower body mounting plate 60 further includes struck-up trunion portions 66 fixedly carrying pivot pin 68 for pivotally mounting a door hinge portion 70 also formed as a stamping and including a carrier portion 72 supporting a pin 74 for rotatively supporting a check roller 76. The check roller engages a leaf spring 78 carried with the lower door mounting plate 60 in the fashion described in the Applicant's previous patent. It is to be understood, however, that other check mechanisms operatively connected between a body hinge part and a door hinge part and physically carried with them may be substituted for that described within the scope of the present invention as defined by the appended claims. It is to be understood, as reference to U.S. Pat. No. 4,532,675 shows, that the door hinge and check mechanism 18 might be configured with a door mounting plate integrally formed with the lower door hinge portion 70. In the present invention, however, a departure from this teaching has been found useful in automotive assembly. The door plate 58 is formed as a stamping and includes a hinge mounting portion 78 having a pair of spaced mounting feet 80 which are each pierced by a slot-like aperture 82 for providing a range of tolerance and assembly to the vehicle body 12. The mounting feet 80 are bridged by a central portion 84 which may be slightly raised as shown in FIGS. 4 and 5 and which includes upstruck tab portion 86 for abuttingly engaging a lower support plate portion 88 of the lower door hinge portion 70 of the door hinge and check mechanism 56. The lower door mounting plate 58 also includes an attachment portion 90 which extends perpendicularly from the central portion 84 and includes an aperture 92 for receiving a retaining bolt 94 threadedly engageable through an aperture 96 in the carrier portion 72 of lower door hinge portion 70.

METHOD OF DOOR ASSEMBLY

During automotive assembly, the door 14 of the vehicle 10 is partially assembled and the upper hinge assembly 16 and the lower hinge assembly 18 are secured to it by securing the upper door mounting plate 22 and the lower door mounting plate 58 to portions of the door 14. The relative vertical positioning of the upper door mounting plate and the upper body mounting plate 22, 20, respectively, is established by the spacing of the abutting surfaces of the upper and lower pivot pins 24, 26 with the bearings 38. The location of the slotted apertures 46 in turn with respect to the abutting bearing and pin surfaces is utilized to control the position of the hinge assembly 16 with respect to the door. Similarly, the cooperation between the upstruck abutment tab 86 of the lower door mounting plate 58 with the abutting surface 88 of carrier portion 72 vertically fixes the relative position of the door hinge and check mechanism 56 with respect to the lower door mounting plate 58 and the location of their abutting cooperation with respect to the slots 82 of mounting feet 80 is utilized to position the lower door hinge assembly 18 with respect to the door. The desired spacing between the two mounted hinges is established by assembly fixturing not a part of our present invention.

With the upper and lower door hinge assembly 16, 18, respectively, secured to the door 14 and pivotally arranged in their closed positions, the door is brought to the vehicle body 12 and the fastening bolts 32, 65 of upper and lower door hinge assembly 16, 18, respectively, are inserted through corresponding apertures (not shown) in portions of the vehicle body 12 where mating fasteners (not shown) are utilized to secure them to the vehicle body 12. Appropriate assembly fixturing and measuring techniques are utilized to ensure that the positioning of the door 14 so hung is arranged to provide specified clearances throughout the periphery of the door 14, spacing it from portions of the vehicle body 12. When this adjustment is complete, the fasteners mating with the bolts 32, 65 and other fasteners inserted through the body plate apertures 30,64 are securely tightened. It should be appreciated, however, that final welding securing of the body mounting plate 26, 60 is also contemplated as a possible expedient within the scope of the present invention. At this stage of the assembly, the door 14 is properly fitted with respect to the body 12 of vehicle 10 and the body 12 in its thus assembled state may be passed through other assembly line operations such as painting. At some point in the assembly operation, however, it is generally expedient to remove the door 14 from the vehicle body since mechanisms which could not go through certain other assembly processes such as painting could be more efficiently added in an offline assembly operation. Exemplary of such systems are the windows and window regulating systems, the door handles and door locks and the trim portions of the interior side of the door. The door mounting system of the present invention greatly enhances the capacity to effect such removal since only the retaining bolt 94 must be removed in order to permit lifting off the door from its hinges. The lower hinge is entirely separated by the removal of the single retaining bolt 94 and pivotal movement of the door toward its open position permits the upstruck abutment tab 52 of the upper door mounting plate 22 to pass the lower upstruck trunion portion 36 of the upper body mounting plate 20 and therefore permits the lift-off of the door 14 with the upper door mounting plate 22.

Turning lastly to the modification of the upper door hinge of the present invention in which it has been found to be useful in the assembly sequence just described in FIGS. 6 and 7 that a modified upstruck abutment tab 152 be provided in which an aperture 98 is formed for snugly receiving a shank portion 100 of a push pin 102. The push-pin 102 is preferably formed on some readily frangible material, such as a plastic, and includes a reduced diameter portion 104 which is received in an aperture 106 formed in a modified leg portion 150 of the upper door mounting plate 122. The apertures 98, 106 are positioned to be in axial registration when the upper door hinge assembly 16 is in the closed position, as is desired during the initial portion of the assembly sequence described above. With the push pin 102 inserted, the closed position of the upper door hinge assembly 116 is assured and inadvertent lift-off and separation of parts is not possible. After assembly of the door 14 to the vehicle, opening of the door will break the push-pin 102, allowing subsequent pivoting operation without interference from it.

While only certain embodiments of the door mounting system and hinges of the present invention have been shown and described, others are possible without departing from the scope of the appended claims.

I claim:

1. A mounting arrangement for assembling a vehicle door to a vehicle body comprising:

an upper hinge assembly having a body mounting plate adapted to be secured to the vehicle body, a door mounting plate adapted to be secured to the vehicle door and means for mounting the body and door mounting plates for pivotal movement with respect to each other and for permitting separation of the plates from each other by effecting vertical lifting movement of one with respect to the other;

a lower hinge assembly having a body mounting plate adapted to be secured to the vehicle body, a door hinge portion pivotally mounted on the lower body mounting plate and secured vertically with respect thereto for movement with the vehicle door and including means for receiving a fastener, and a lower door mounting plate adapted to be secured to the vehicle door and including an attachment portion having an aperture formed therein for receiving therethrough the fastener for engagement with the lower door hinge portion, the means for receiving the fastener and the aperture both having a complementary shape to the shape of the fastener and both being or substantially the same size as the fastener to prevent vertical movement between the lower door mounting plate and the lower door hinge portion;

the upper and lower hinge assemblies being vertically spaced to permit lift-off separation of the upper hinge mounting plate from the upper hinge door plate upon removal of the fastener.

2. A mounting arrangement as defined in claim 1 wherein the lower door mounting plate is integrally formed to include a pair of vertically spaced mounting ears shaped to abuttingly engage a portion of the vehicle door and a central portion spanning the mounting ears and having an upstruck abutting surface extending outwardly away from the door portion for supporting engagement with a lower surface of the door hinge portion.

3. A mounting arrangement as defined in claim 2 wherein the lower door mounting plate is formed as a stamping.

4. A mounting arrangement as defined in claim 2 wherein means are provided for preventing separation of the upper hinge mounting plates when the mounting plates are in the closed position of the vehicle door.

5. A mounting arrangement as defined in claim 1 wherein the lower door mounting plate is formed as a stamping.

6. A mounting arrangement as defined in claim 5 wherein means are provided for preventing separation of the upper hinge mounting plates when the mounting plates are in the closed position of the vehicle door.

7. A mounting arrangement as defined in claim 1 wherein means are provided for preventing separation of the upper hinge mounting plates when the mounting plates are in the closed position of the vehicle door.

8. A mounting arrangement for assembling a vehicle door to a vehicle body comprising:

an upper hinge assembly having a body mounting plate adapted to be secured to the vehicle body, a door mounting plate adapted to be secured to the vehicle door and means for mounting the body and door mounting plates for pivotal movement with respect to each other and for permitting separation of the plates from each other by effecting vertical lifting movement of one with respect to the other;

a lower hinge assembly having a body mounting plate adapted to be secured to the vehicle body, a door hinge portion pivotally mounted on the lower body mounting plate and secured vertically with respect thereto for movement with the vehicle door and including means for receiving a fastener, and a lower door mounting plate adapted to be secured to the vehicle door and including an attachment portion having an aperture formed therein for receiving therethrough the fastener for engagement with the lower door hinge portion, the means for receiving the fastener and the aperture both having a complementary shape to the shape of the fastener and both being of substantially the same size as the fastener to prevent vertical movement between the lower door mounting plate and the lower door hinge portion;

the upper and lower hinge assemblies being vertically spaced to permit lift-off separation of the upper hinge mounting plate from the upper hinge door plate upon removal of the fastener; and the lower door mounting plate having integrally formed therewith an abutting surface for supportively engaging a lower surface of the door hinge portion.

* * * * *